US009545628B2

(12) United States Patent
Armau

(10) Patent No.: US 9,545,628 B2
(45) Date of Patent: Jan. 17, 2017

(54) SYSTEMS FOR THE TRANSFER BETWEEN A CHAMBER AND A CONTAINER

(75) Inventor: Stephanie Armau, Ossun (FR)

(73) Assignee: SARTORIUS STEDIM ASEPTICS, Lourdes (FR)

( * ) Notice: Subject to any disclaimer, the term of this patent is extended or adjusted under 35 U.S.C. 154(b) by 688 days.

(21) Appl. No.: 13/503,188

(22) PCT Filed: Sep. 22, 2010

(86) PCT No.: PCT/FR2010/051995
§ 371 (c)(1),
(2), (4) Date: Apr. 20, 2012

(87) PCT Pub. No.: WO2011/048295
PCT Pub. Date: Apr. 28, 2011

(65) Prior Publication Data

US 2012/0219388 A1 Aug. 30, 2012

(30) Foreign Application Priority Data

Oct. 20, 2009 (FR) ..... 09 57367

(51) Int. Cl.
*B01L 1/02* (2006.01)
*B01L 3/00* (2006.01)

(52) U.S. Cl.
CPC .. *B01L 1/02* (2013.01); *B01L 3/54* (2013.01); *B01L 2200/025* (2013.01);
(Continued)

(58) Field of Classification Search
CPC ..... G07C 9/00007; G07C 9/00103; G07C 9/00111; B01L 1/00; B01L 1/02; B01L 2200/025; B01L 2200/141; B01L 2300/023; B01L 2300/041; B01L 2300/046; B01L 3/54
(Continued)

(56) References Cited

U.S. PATENT DOCUMENTS 5,853,207 A 12/1998 Martin et al.
6,553,722 B1 * 4/2003 Porret et al. ..... 49/507
(Continued)

FOREIGN PATENT DOCUMENTS

EP 0 688 020 12/1995
EP 1 583 048 10/2005
(Continued)

OTHER PUBLICATIONS

Biosafe Single-Use Aseptic Transfer Systems, SPT1001-c08021, Ver. 2, published 2008.*
(Continued)

*Primary Examiner* — Jason K Niesz
*Assistant Examiner* — Andrew StClair
(74) *Attorney, Agent, or Firm* — Young & Thompson

(57) ABSTRACT

The chamber (2) includes a wall (5) having an opening (7) and a connection interface (8), a door (10), joining elements (12), elements for maneuvering the door (10) and actuating elements for control of the maneuvering elements. The container (3) includes a wall (14) having an opening (16), a connection interface (9), a door (18), joining elements (13) and elements for maneuvering the door that are functionally joined to the door, and the system also includes, functionally integrated, marking elements, that rest on the container and that can store data, elements for short-range data reading that are functionally complementary to the marking elements, elements for storing read data, elements for producing an output signal based on read or stored data, and elements for controlling the opening of the first door and thus the second door, that respond to the output signal received from the elements for producing an output signal.

14 Claims, 4 Drawing Sheets

(52) U.S. Cl.
CPC ... *B01L 2200/141* (2013.01); *B01L 2300/023* (2013.01); *B01L 2300/024* (2013.01); *B01L 2300/041* (2013.01); *B01L 2300/046* (2013.01)

(58) Field of Classification Search
USPC ..... 455/41.2, 78; 141/94, 250, 270
See application file for complete search history.

(56) References Cited

U.S. PATENT DOCUMENTS

| | | | | |
|---|---|---|---|---|
| 6,591,662 | B1 | 7/2003 | Grimard et al. | |
| 7,451,935 | B2 * | 11/2008 | Chang | 235/492 |
| 7,748,903 | B2 * | 7/2010 | Saint-Martin et al. | 383/36 |
| 2002/0183882 | A1 * | 12/2002 | Dearing et al. | 700/115 |
| 2002/0189667 | A1 * | 12/2002 | O'Dougherty et al. | 137/1 |
| 2003/0072676 | A1 | 4/2003 | Fletcher-Haynes et al. | |
| 2004/0051368 | A1 * | 3/2004 | Caputo et al. | 299/1.9 |
| 2005/0116021 | A1 * | 6/2005 | O'Dougherty | 235/375 |
| 2005/0134433 | A1 * | 6/2005 | Sweeney, II | 340/10.1 |
| 2006/0249088 | A1 * | 11/2006 | Eu | 119/51.02 |
| 2006/0252366 | A1 * | 11/2006 | Eu | 455/3.06 |
| 2007/0008138 | A1 * | 1/2007 | Mosher et al. | 340/572.4 |
| 2007/0095426 | A1 * | 5/2007 | Saint-Martin | B01L 3/505 141/312 |
| 2008/0086235 | A1 * | 4/2008 | Frankel | 700/244 |
| 2008/0103626 | A1 * | 5/2008 | Frankel | 700/231 |
| 2008/0131629 | A1 | 6/2008 | Chisholm et al. | |
| 2008/0224875 | A1 * | 9/2008 | Phillips et al. | 340/572.8 |

FOREIGN PATENT DOCUMENTS

| | | |
|---|---|---|
| EP | 1 850 289 | 10/2007 |
| EP | 1 887 581 | 2/2008 |
| EP | 2 012 323 | 1/2009 |
| EP | 2 080 553 | 7/2009 |
| FR | 1 346 486 | 12/1963 |
| FR | 2 782 071 | 2/2000 |
| FR | 2 787 190 | 6/2000 |
| WO | 00/36610 | 6/2000 |
| WO | 03/026724 | 4/2003 |
| WO | 2008/069846 | 6/2008 |

OTHER PUBLICATIONS

International Search Report dated Jan. 20, 2011, corresponding to PCT/FR2010/051995.

* cited by examiner

SYSTEMS FOR THE TRANSFER BETWEEN A CHAMBER AND A CONTAINER

BACKGROUND OF THE INVENTION

Field of the Invention

The invention relates to improvements made to systems, which are isolated from the external environment, for transferring a certain content between a chamber and a container. The improvements apply regardless of the direction of the transfer. However, in practice, it is understood that, all other things being equal, the transfer always occurs in the same direction.

Description of the Related Art

More particularly in the biopharmaceutical field, different embodiments of systems for transferring, in isolation from the external environment, a certain content, in one direction or another, between a chamber and a partially flexible container that can be moved relative to the chamber, are known.

One of these systems is known under the trademark BIOSAFE®, this system not being exclusive of others. Systems of this type are also described in, in particular, documents FR-A-1346486, EP-A-0688020, FR-A-2782071, and WO00/36610.

The device that is the object of the document FR-A-2 787 190, which describes a sealed junction device comprising two chambers equipped, respectively, with an access opening equipped with a door working with a flange and locking means on their respective flanges; connecting means that make it possible to link the two chambers and to form a passage between them, without running the risk of introducing therein elements coming from the external environment; and a mechanism that makes it possible to detect when the seal between the two chambers and the external environment is no longer ensured, are also known from the state of the art.

Transfers, such as those that can be carried out by such systems, can be necessary in a number of technical fields, in particular, but not exclusively, the biopharmaceutical field. The invention pertains quite especially to this field, as to those that can be considered as similar in regard to the requirements imposed.

The content—to be transferred or that is already transferred—is not crucial in and of itself in regard to the invention apart from the fact that it is designed to be, and thus must be able to be, transferred. In the biopharmaceutical field, it can, for example, involve a sterile object such as a container, a container element such as a plug, or a syringe, but also elements for monitoring the environment, or even waste produced during production or treatment operations, waste that is to be transferred in order to eliminate it.

Transfers, such as those considered here, occur within the framework of more complex processes in which a certain content undergoes one or more operations before and/or after transfer. These operations consist of production, treatment, handling, use, measurement, monitoring, analysis, etc.

The chamber of the transfer system can be, for example, rigid, stationary, and of more or less large size and typically comprises:

- A first wall, for example rigid, provided with a first opening, for example circular, and with a first connection interface, for example a flanged device;

- A first door, for example in the shape of a disk, mounted to move and arranged to be in the closed state or in the open state where, respectively, it closes or opens the first opening;
- First joining means, for example joined to the first connection interface;
- First maneuvering means of the first door to move it from one state to the other, for example, in the form of an arm, lever or the like;
- External actuating means, for example, in the form of one or more handles, for controlling the first maneuvering means.

In the case of a production line, a chamber, comprising a wall equipped with the same number of openings, connection interfaces, doors, joining means, means for maneuvering the door, and just as many transfer systems, is provided.

The container of the transfer system can be partially flexible and movable, such as a pouch.

Such a container can typically comprise:

- A second wall provided with a second opening like the first opening that, when the container is joined to the chamber, is in communication with the first opening, and a second connection interface, for example, an additional flanged device of the first connection interface;
- A second door arranged to be in the closed state or in the open state, where it closes or opens respectively the second opening;
- Second joining means capable of working with the first joining means so as to produce a stationary, detachable, and airtight joining of the container to the chamber;
- Second means for maneuvering the second door to move it from one state to the other, functionally joined to the first door, so that the opening or the closing of the first door can result in, respectively, the opening or closing of the second door.

In the case of the transfer of the container to the chamber, at the beginning, the container is filled with its content, is disjoined from the chamber, and the first door and second door are in the closed state.

The operator draws the container close to the chamber and joins them, making their interfaces and their respective joining means work together. The container is then mounted on the chamber and accessible to the operator. If necessary, these operations are fully or partially automated.

In this situation, the operator can activate the actuating means, for example, to make the handle or handles that are part of it pivot. Alternately, this operation is either fully or partially automated.

The actuation, regardless of the manner in which it is achieved, controls the first maneuvering means, which move the first door from its closed state to its open state. The movement of the first door concomitantly leads to that of the second door. Thus, the two doors are brought from the closed state to the open state.

In this situation, the container is in tight communication—isolated from the external environment—with the chamber via their two open openings.

The operator can then transfer the content of the container into the chamber via the two openings in an airtight manner—isolated from the external environment. Or, as above, this operation is fully or partially automated.

Once the container is thus transferred, the operator can activate the actuating means, thereby controlling the first maneuvering means, which move the first door from its open state to its closed state and concomitantly that move the second door from its open state to its closed state.

The operator can then disjoin the container from the chamber. Or, as above, this operation is fully or partially automated.

Instead of the transfer taking place in the direction from the container to the chamber, it can take place in the opposite direction, from the chamber to the container. The operations then carried out are derived from those described above.

As appropriate, the container may or may not be for single use and then discarded after being used.

Such a system provides satisfaction regarding the transfer per se. Nevertheless, in the case of certain applications, particularly in the biopharmaceutical field, within the framework of the process in which this transfer occurs, the fact that the transfer per se provides satisfaction is not sufficient.

Actually, it is important, first of all, to ensure the safety of the transfers, for example to avoid the consequences that could result from mixing batches of containers filled with contents, or from bad handling or from the transfer of a content that should not have been transferred for whatever reason. This safety requirement is made all the more difficult since, visually, the containers look alike and the transfers must be carried out at a certain rate.

It is also important that the traceability of the contents is ensured during most of their shelf lives: before and after transfer.

It is also important to avoid consequences that might result from the transfer, not of the content to be transferred, but of a duplicate of the latter.

It is also important, in the case of single-use containers, that the container that was used for a transfer cannot be used for a subsequent transfer.

An embodiment using a bar code that attempts to provide a solution to the problem by using a bar code is known. However, this embodiment is not satisfactory since it is too complex.

Furthermore, the system of radio identification, currently designated RFID (Radio Frequency IDentification), which comprises, on the one hand, a transponder or RFID tag, which can be in the form of a label that has a substrate or the like bearing an antenna and an electronic chip and, on the other hand, a transmitter-receiver or reader, which can activate the transponder located a short distance away, is known. Thus, the transponder can receive the radio requests transmitted by the transmitter-receiver and respond to them. RFID technology is used for identification, traceability, verification testing, tracking, electronic opening of doors, access control, and communication.

The document WO2008/069846 describes a plastic container and a preform having an encapsulated RFID insert. The document EP-A-1583048 describes a process for producing a container with an RFID element.

The documents EP-A-1887581 and EP-A-2012323 refer to the sterilization or the radiation of a pharmaceutical device that comprises an RFID label.

The document EP-A-1850289 explains the application of an RFID system for the "workflow" of blood transfusion centers.

The document US-A-2003/0072676 describes a pouch that is designed to contain a blood product provided with an RFID label.

The document EP-A-2 080 553 relates to a method and a system designed to locate and identify test tubes placed in a receiving fixture by using labels fixed to the outside wall of these test tubes and that have a bar code. More particularly, the method comprises a series of stages that consists in scanning the bar codes so as to record the corresponding identification data and to determine the position of each test tube in the receiving fixture; if necessary, to read the additional data recorded on the RFID chips provided behind the labels; and to correlate the identification data, the positioning data and the additional data of each test tube.

Other means capable of storing information and transmitting it, making its short-range reading possible, and then of storing it for a certain use, are also known. Such systems operate either by radio, by infrared, or else by hard-wire connection. Techniques known under the trademarks of, for example, Bluetooth®, Zigbee® . . . are known.

Consequently, in the pharmaceutical field, as in those fields that can be considered similar in regard to the imposed requirements, systems, which are isolated from the external environment, for transferring a certain content between a chamber and a container, in one direction or another, need to be improved in regard to securing transfers, to the traceability of the contents during most of their shelf lives: before and after transfer, in regard to consequences that could result from the transfer, not of the content to be transferred, but of a duplicate of the latter, and finally in regard to the effectiveness of single-use containers holding the contents to be transferred. These improvements need to be provided in a simple fashion, to operate automatically as much as possible, and by means of equipment that is as inexpensive as possible.

BRIEF SUMMARY OF THE INVENTION

The invention provides a solution to these needs, and it finds an application that is particularly well suited to the biopharmaceutical field but can be applied in other similar fields where the same needs arise.

For this purpose, according to a first aspect, the invention relates to a system for transferring a certain content in one direction or another between a chamber and a container that is at least partially flexible and that can be moved relative to the chamber, The chamber comprising:

- A first wall provided with a first opening and a first connection interface,
- A first door arranged to be in the closed state or in the open state where, respectively, it closes or opens the first opening,
- First joining means,
- First means for maneuvering the first door to move it from one state to the other,
- And means for actuating and controlling the first maneuvering means, The container comprising:

- A second wall provided with a second opening that, when the container is joined to the chamber, is in communication with the first opening, and with a second connection interface in addition to the first connection interface,
- A second door arranged to be in the closed state or in the open state, where, respectively, it closes or opens the second opening,
- Second joining means that can work with the first joining means so as to produce a stationary, detachable, and airtight joining of the container to the chamber,
- And second means for maneuvering the second door to move it from one state to the other, functionally joined to the first door, which makes it possible for the opening or closing of the first door to result in, respectively, the opening or closing of the second door, The initial location of the content being either the container or the chamber and its final location being either the chamber or the container, The system being able, when the container is joined to the chamber, and once the first door and the second door are moved to the open state, to transfer the content from its initial location to its final location while being isolated from the external environment.

This transfer system is such that it comprises, in addition, functionally integrated:

Marking means, which rest on the container, which can store data,

Means for short-range reading of data, functionally complementary to the marking means, Means for storing read data, Means for producing an output signal based on the data read or stored, and Means for controlling the opening of the first door and thus the second door that respond to the output signal received from the means for producing an output signal.

According to a preferred embodiment, the transfer system also comprises means for writing data into the marking means, functionally joined to the opening and/or closing of the first door of the chamber.

According to one characteristic, the means for reading data and/or the means for writing data are located, at least during operation of the transfer system, or in preparation for this operation, at a short distance from the marking means, namely at a short distance from the first door or at least from the passage area of the container for the purpose of joining it to the chamber or of locating the container during this joining. For example, the means for reading data and/or the means for writing data rest on the chamber, at least essentially adjacent to the first door of the chamber or to the passage or location area of the container while it is being joined to the chamber.

According to another embodiment, the means for reading data and/or the means for writing data do not rest directly on the chamber, but are located apart from it.

As appropriate, the means for reading data and/or the means for writing data are either arranged in a stationary manner or are movable, in particular portable.

As appropriate, the means for storing read data and/or the means for producing an output signal based on data read or stored and/or the means for controlling the opening of the first door may or may not rest on the chamber.

As appropriate, the marking means and the data reading means communicate by radio, infrared, or hard-wire connection. The same is true for the writing means and the marking means.

As appropriate, the marking means are of the read/rewrite type or of the read-only type.

According to a possible, but nonlimiting embodiment, the marking means are a transponder or RFID label.

According to an embodiment, the means for producing an output signal also provide a visual or audible signal perceptible to the operator.

According to a second aspect, the object of the invention is a production line comprising a chamber that is composed of a wall provided with the same number of openings, connection interfaces, doors, joining means, means for maneuvering the door, and the same number of transfer systems, each as it has just been described, functionally arranged from upstream to downstream, the line operating step by step in connection with each transfer system.

According to an embodiment of such a production line, the means for controlling the opening of one of the doors of the chamber respond to the signal received from the means for producing an output signal of a transfer system located upstream.

According to a third aspect, the object of the invention is a process for implementing a transfer system such as was previously described, in which:

Data concerning the container in question or its content are written onto the marking means, The container is brought close to the chamber, their doors being in the closed state, They are joined by having their respective interfaces and joining means work together, The data written onto the marking means are read using the data reading means, and the data read using the storing means are stored, An output signal based on read or stored data is produced, and The opening of the first door, and thus the second door, is controlled in response to the output signal.

According to one characteristic of the process, the control means are programmed not to allow—and even to prevent—the control of the opening of the first door, if the output signal means that the container in question must not be used for a transfer.

According to an embodiment in the case of a transfer system also comprising writing means, the marking means being of the read/rewrite type, the process also includes a stage in which, using the writing means, a piece of data, corresponding to the fact that the container was already used for a transfer and must not be used for another subsequent transfer, is written onto the marking means.

According to an embodiment of the process, during the process of producing at least one container, preparing its content, filling it with the content, and treatment, multiple pieces of information relative to the container in question and its content are written onto the marking means.

According to an embodiment of the process implemented with a transfer system including writing means, data regarding the prior joining of the container in question in relation to an initial first door of the chamber is written onto the marking means, so as to prevent any opening of a subsequent first door in the case of subsequent joining of the container in question in relation to this subsequent first door.

According to a fourth aspect, the object of the invention is a container specially designed for a transfer system or a production line as was previously described, which comprises a wall forming an envelope, an annular joining flange, attached in an airtight manner to the wall forming the envelope around an opening and provided with joining means that can work with the first means for assembling the chamber, a door placed on the flange and arranged to be in the closed state or in the open state, means for maneuvering the door to have it move from one state to the other, functionally joined to the first door of the chamber, and marking means that can store data.

According to an embodiment, the wall forming an envelope is flexible, and the flange is rigid.

As appropriate, and as already indicated, the marking means are of the read/rewrite type or of the read-only type.

According to a possible but nonlimiting embodiment, as already indicated, the marking means are a transponder or RFID label.

According to an embodiment, the marking means are attached rigidly, and in a manner that is normally inseparable, to the wall forming the envelope.

This embodiment can have as execution characteristics that the marking means are attached to the wall forming the envelope and are placed at least essentially on the surface of the latter; that they are attached to this wall by an adhesion means inserted between them; that they are located in the vicinity of the flange, the second opening, the second door and/or in a less flexible area of the container such as an area where the wall is sealed together; and that they are located on the side of the outside surface of the wall forming an envelope.

According to another embodiment, the marking means are attached, rigidly and in a manner that is normally inseparable, to the joining flange.

This other embodiment can have as execution characteristics that the marking means are connected to the joining flange and attached to it by an adhesion means inserted between them or attached to the flange by inlaying or forcible embedding after production of the flange or attached to the flange during production of the latter by injection. Moreover, the marking means can be placed in a receiving cavity provided in the joining flange in such a way as to offer a front surface that is essentially coplanar with the surface of the flange that is around the cavity, in particular a cavity that opens on the front surface of the flange forming a connection interface with an interface of the chamber.

According to another embodiment, the marking means are enclosed in a pouch, connected to and attached rigidly in a manner that is normally inseparable, to the container.

This other embodiment can have as execution characteristics that the pouch is attached to the wall forming an envelope and/or to the flange; that the pouch is located in the vicinity of the flange, of the second opening, of the second door and/or in a less flexible area of the container such as an area where the wall is sealed together; and, as appropriate, that the pouch is located on the side of the outside surface or the inside surface of the wall forming an envelope.

According to another embodiment, the marking means are connected to the container by a flexible or rigid link so that they cannot be separated in an untimely manner from the container with which they form an inseparable unit.

According to a fifth aspect, the object of the invention is a chamber specially designed for a transfer system or a production line such as previously described, which comprises a first wall provided with a first opening and a first connection interface, a first door arranged so as to be in the closed state or the open state where, respectively, it closes or opens the first opening, first joining means, first means for maneuvering the first door to move it from one state to the other, external actuation and control means of the first maneuvering means, and in which means for short-range reading of data, means for storing read data, means for producing an output signal based on read or stored data, and means for controlling the opening of the first door that respond to the signal received from the production means of an output signal are functionally joined to it.

According to an embodiment, as already indicated, the means for reading data, and/or the means for storing read data, and/or the means for producing an output signal based on the read and stored data, and/or the means for controlling the opening of the first door, rest on the chamber.

According to an embodiment, as already indicated, the means for reading data are at least essentially adjacent to the first door.

BRIEF DESCRIPTION OF THE DRAWINGS

Several embodiments of the invention are now described with the help of drawings in which.

DETAILED DESCRIPTION OF THE PREFERRED EMBODIMENTS

Figure 1:
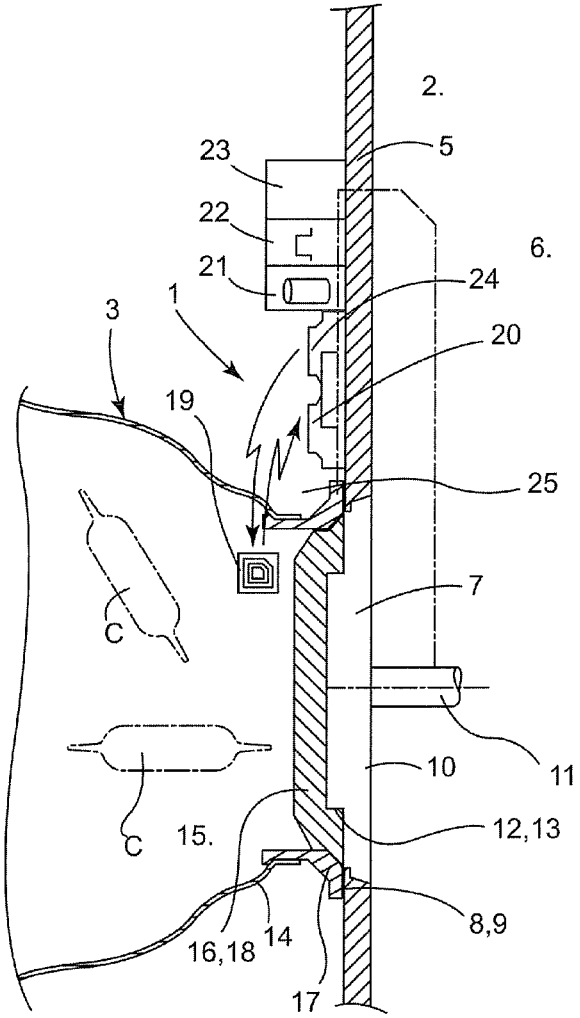
FIG. 1 is a diagrammatic view that symbolically shows a transfer system according to the invention, which comprises a chamber, a container, a content, marking means, reading means, storing means, means for producing an output signal based on control means; in this embodiment, means for reading, storing, producing an output and control signal rest securely on the chamber in the vicinity of its door.

The invention relates to a transfer system 1 that comprises a chamber 2 and a container 3. System is defined as the fact that the chamber 2 and the container 3 are functionally joined to ensure the transfer operation.

The invention also relates to the chamber 2 and container 3 insofar as they are specially designed to be part of the transfer system 1.

Such a transfer system 1 can exist per se and operate by itself. It can also be integrated into a production line 4 that comprises an n number of transfer systems 1, certain parts of which are common, these transfer systems 1 being arranged together both structurally and functionally.

Such a transfer system 1 is designed to ensure the transfer of a certain content C as appropriate, either from the container 3 (initial location) to the chamber 2 (final location)

or from the chamber 2 (initial location) to the container 3 (final location) while isolating it during this transfer from the external environment.

Such a transfer system 1 is more particularly adapted to the biopharmaceutical field. However, such a transfer system can be used in other technical fields where the same needs arise.

The chamber 2 is now described in a possible, but nonlimiting embodiment provided purely by way of example.

The chamber 2 is typically designed to be able to carry out such and such a desired operation on the content C while isolating it from the external environment. For example, it involves filling or emptying a content C that makes up a container or else joining it to one or more other parts, or else recovering a waste product for the purpose of eliminating it . . . . Consequently, the chamber 2 is for repeated use. It can be rather voluminous (for example on the order of one or more meters on a side) and is permanently stationary.

In this embodiment, the chamber 2 comprises a first wall 5 (or a set of walls) that is rigid and forms the outside border of a first space 6, that is closed-in and more or less large as required.

Most often, the chamber 2 is rather voluminous (for example on the order of one or more meters on a side), and it is stationary.

Conventionally, the term "first" is used to describe what relates to the chamber 2, whereas the term "second" is used to describe what relates to the container 3.

The first wall 5 is provided with a first opening 7 that is designed to allow the passage of the content C in the desired direction between the chamber 2 and the container 3, and thus having the dimension that allows this passage.

The first wall 5 comprises a first connection interface 8, such as a seat formed by the outside surface of the wall 5 around the first opening 7, with which a second interface 9 of the container 3 is designed to work.

The chamber 2 also comprises a first door 10 arranged and mounted on support means 11 so that it can be moved between one position where it is in the closed state and seals the first opening 7, and another position where it is in the open state and does not seal the first opening 7.

The chamber 2 also comprises first joining means 12, designed to work with the second joining means 13 of the container 3.

The chamber 2 also comprises first maneuvering means of the first door 10 to move it from one state to the other, and actuation and control means of these first maneuvering means, for example placed on the outside of the chamber 2.

Concerning a production line 4, it comprises a chamber that delimits a common space 6 for an n number of openings 7, n interfaces 8, n doors 10, and n joining means 12.

Container 3 is now described in a possible, but nonlimiting embodiment provided purely by way of example.

Container 3 is typically designed to be able to ensure an operation of packaging, storing, handling, and transport of the content C while isolating it from the external environment, either because the content C is located there initially and must be transferred into the chamber 2, or because the content is located there ultimately, having been transferred there from the chamber 2. However, the container 3 can also serve as a treatment space, with the content C, which is located there, undergoing there one or more treatment operations, such as, for example, sterilization.

In the case where the container 3 is the initial location of the content C—in relation to the transfer in question—, the container 3 could be used—in particular be filled with the content C—well before the actual transfer. Conversely, in the case where the container 3 is the final location of the content C—in relation to the transfer in question—, the container **3*a*** could be used—in particular be emptied of the content C—well after the actual transfer.

If the transfer process considered here must be carried out in isolation relative to the external environment, the container 3 is most often for a single use.

The container 3 can be moved relative to the chamber 2, for example from a preparation or storage location at a distance from the chamber 2, to a location where the container 3 is joined to the chamber 2.

Typically, the container 3 is at least partially flexible, relatively small in size, for example easily handled by an operator. For example, the container 3 forms a kind of pouch.

In the embodiment described, the container 3 comprises a second wall 14 that is flexible and forms the outside border of a second space 15 that is closed-in and that can contain the content C.

The second wall 14 is provided with a second opening 16 designed to allow the passage of the content C in the desired direction between the chamber 2 and the container 3, and thus having the dimension that allows this passage.

The second wall 14 comprises the second connection interface 9.

The second opening 16 is such that, when the container 3 is joined to the chamber 2, it is in communication with the first opening 7.

Moreover, the second connection interface 9 is in addition to the first connection interface 8.

The second opening 16 and the second connection interface 9 can be produced in a rigid annular flange 17 around which is attached, in an airtight manner, the second flexible wall 14.

The container 3 also comprises a second door 18 arranged and mounted in a way so that it can be moved between one position where it is in the closed state and seals the second opening 16, and another position where it is in the open state and does not seal the second opening 16.

The container 3 also comprises the second joining means 13, designed to work with the first joining means 12 of the chamber 2, so as to be able to produce a stationary, detachable, and airtight joining of the container 3 to the chamber 2.

The container 3 also comprises second means for maneuvering the second door 14 to move it from one state to the other, functionally joined to the first door 10, that make it possible for the opening or the closing of the first door 10 to result in, respectively, the opening or the closing of the second door 14. For example, these means are magnets.

When the container 3 is joined to the chamber 2, and once the first door 10 and the second door 14 are brought to the open state, it is possible to transfer the content C from its initial location to its final location while being isolated from the external environment.

As was already indicated, the content C to be transferred is not crucial per se in relation to the invention apart from the fact that it is designed to, and thus must be able to, be transferred. It can involve, for example, a sterile object such as a container, a container element such as a plug, or a syringe, but also elements for monitoring the environment, or even waste produced during production or treatment operations, waste that is to be transferred in order to eliminate it . . . .

With the transfer taking place within the framework of a more complex and general process, it must be seen in this context.

First, the content C most often undergoes one or more operations before and/or after the transfer (production, treatment, handling, use, measurement, monitoring, analysis, etc.). All of these operations and the details of the latter are just so many pieces of information (or data) that are specific to the content C, and at least partially to the container 3 that received it, which are important to be able to track.

Among these pieces of information (or data), there are some that are relative to the transfer in question or to the fact that the container 3 was already used during a previous transfer; more generally, it results from the pieces of information (or data) that a transfer should not be able to occur.

Secondly, the transfer does not involve only a single content C and a single container 3, but a number of them, which it is also important to be able to separate, distinguish, and reference. The identification of the content C, which is the object of the transfer in one or more sets of contents and that of the container 3 that is the object of the transfer in one or more sets of containers 3, also are just so many pieces of information (or data) specific to the content C or to the container 3 that received it, which are important to be able to track. As previously, it may be that there is information (or data) from which it results that a transfer should not be able to occur.

In all cases, a collection of information (data) that is useful in relation to the transfer or to the process in which the transfer is involved can be joined to a container 3 that is empty or filled with its content and thus with the content that is in this container 3. This information constitutes data D that can be expressed, recorded, stored, read, transferred, processed and used.

Figure 4:
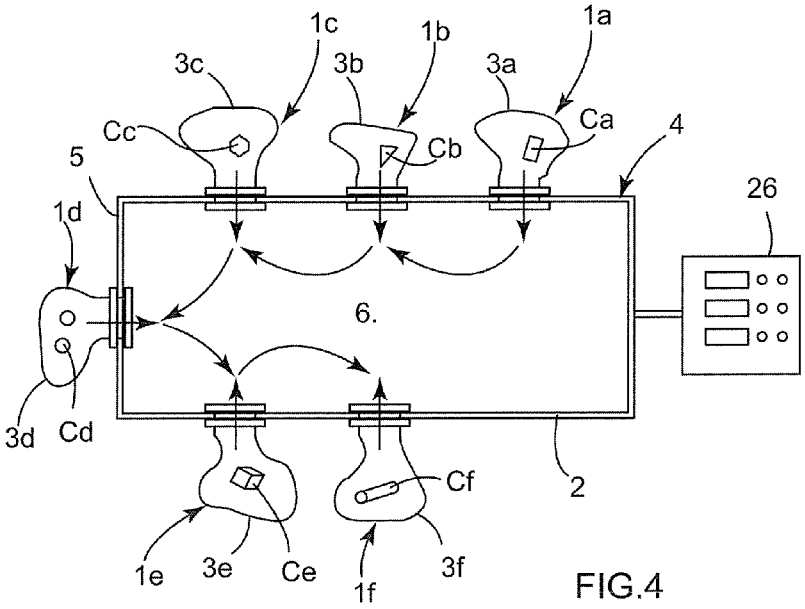
FIG. 4 is a simplified diagrammatic view of a production line that comprises a common chamber and several transfer systems arranged from upstream to downstream.

Thirdly, the process can involve several chambers 2, and thus several transfer systems 1, or a production line 4 that also comprises several transfer systems 1, at least several first doors 10 (FIG. 4).

To respond to the need that the transfer system 1 provides, within the framework of the process in which it takes place, the securing of the transfers, the traceability of the contents C, and a solution to the problem that the transfer would pose, not of the content to be transferred, but of a duplicate of the latter, the system 1 comprises, in addition to the chamber 2 and the container 3 that is filled or intended to receive the content C, a certain number of means that are functionally integrated with the chamber 2 and with the container 3 that have now been described.

The system 1 first of all comprises marking means 19, which rest on the container 3 and which can store the data D.

The system 1 then comprises means 20 for short-range reading of data D that are functionally complementary to the marking means.

It also comprises means 21 for storing read data D, means for producing an output signal 22 based on read or stored data D, and means 23 for controlling the opening of the first door 10 and thus the second door 18, which respond to the output signal received from the means for producing an output signal 22.

To respond to the need to ensure the effectiveness of the single use of the containers 3 holding the contents C to be transferred, which is the preferred embodiment envisioned, the transfer system 1 comprises, in addition, means 24 for writing data D into the marking means 19, functionally joined to the opening and/or closing of the first door 10 of the chamber 2, or to an event linked to this opening and/or closing.

In this case, the marking means 19 are of the read/rewrite type. Thus, the writing means 24 can write into the marking means 19 a piece of data corresponding to the fact that the corresponding container 3 was used for a transfer and thus joined to a first door 10 of a chamber 2. This piece of data then is part of the data set D stored by the marking means 19 of the container 3.

If, subsequently, a user considers using the same container 3 for a new transfer, and thus a joining to a new first door 10 of a chamber 2, after the preceding joining, the reading means 20 of the chamber 2 with which this new transfer can be considered will read the piece of data corresponding to the fact that the corresponding container 3 was used for a previous transfer; the means for producing an output signal 22 will then produce an output signal taking into consideration this piece of data and, according to the programming done, the control means 23 will not allow—and will even prevent—the opening of the first door 10, guaranteeing a single use of the container 3.

If, contrary to what was just described, such writing into the marking means 19 is not required, writing means 24 are not provided, and the marking means 19 can be of the read-only type.

When provided, the reading means 20 and the writing means 24 are located, at least during operation of the transfer system 1—or in preparation for this operation—at a short distance from the marking means 19 and thus from the container 3 in question. Consequently, when the reading means 20 and the writing means 24 are provided, they are located, at least during operation of the transfer system 1—or in preparation for this operation—a short distance from the first door 10 of the chamber 2, or at least from an area 25 that is the passage area of the container 3—and more particularly from the marking means 19—in preparation for its joining to the chamber 2 or the location area of the container 3—and more particularly from the marking means 14—during this joining to the chamber 2.

This short distance is that which results from the process and the means for communication between the marking means 19 and the reading means 20 and between the writing means 24 and the marking means 19 in the embodiment providing such writing means 24. This short distance is what allows for transmission.

In the embodiments more particularly considered, the marking means 19 and the reading means 20, like the writing means 24 and the marking means 19, communicate by radio, infrared, or hard-wire connection. The short distance in question can be on the order of about ten or several tens of centimeters.

In a possible embodiment, the reading means 20 and the writing means 24 rest directly or indirectly on the chamber 2, in particular the first wall 5, and, more particularly, are at least essentially adjacent—namely in the immediate or close vicinity—to the first door 10 of the chamber 2 (FIG. 1) or to the area 25. In this case, the reading means 20 and the writing means 24 can be arranged in a stationary manner.

Figure 2:
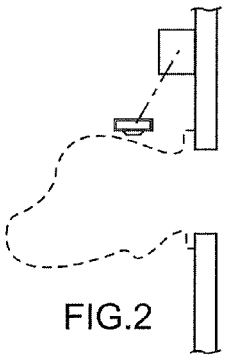
FIG. 2 is a simplified diagrammatic view that illustrates the case where the reading means, while being located, at least during operation of the transfer system—or in preparation for this operation—at a short distance from the marking means and from the container in question, do not rest directly on the chamber, but are located apart from it.

In another possible embodiment, the reading means 20 and possibly the writing means 24, while being located, at least during operation of the transfer system 1—or in preparation for this operation—, at a short distance from the marking means 19 and thus from the container 3 in question, are not resting directly on the chamber, but are located apart from it (FIG. 2).

Figure 3:
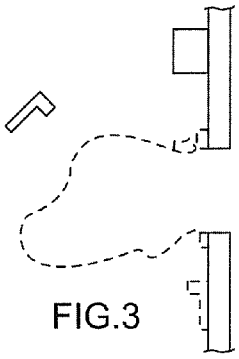
FIG. 3 is a simplified diagrammatic view similar to FIG. 2 that illustrates the case where the reading means are movable, in particular portable, and in the form of a hand-held bar code scanner, which can occupy a rest position (dashes) and a position of use (solid line).

In another possible embodiment, the reading means 20 are movable, in particular portable, while being located, at least during the operation of the transfer system 1—or in preparation for this operation—, at a short distance from the marking means 19 and thus from the container 3 in question. For example, the reading means 20 can take the form of what is currently called a handheld bar code scanner. Such marking means 19 can thus occupy a rest position possibly away from the door 10 and are brought closer during operation of the transfer system 1, or in preparation for this operation. In FIG. 3, the position of use of the marking means 19 in the form of a handheld bar code scanner is depicted by a solid line and the rest position by dashes.

Of course, it cannot be ruled out that the writing means 24 themselves are also movable.

According to the embodiments considered, the storing means 21 and/or the means for producing a signal 22 and/or the control means 23 may or may not rest on the chamber 2, in particular on its first wall 5. Of course, the necessary functional links exist between all of the means.

In a possible but nonlimiting embodiment, the marking means 19 are a transponder or RFID label.

If necessary, it is provided that the means for producing a signal 22 also produce a visual or audible signal perceptible to the operator so as to inform the latter of the state in which the transfer system 1 finds itself, and in particular of the effective completion of opening the doors 10 and 18, and, if necessary, of the effective completion of the transfer of the content C in the direction desired.

In the case of a production line 4 (FIG. 4), the latter comprises a single chamber 2, having a wall 5 provided with the same n number of openings (7*a*, 7*b* . . . 7*n*), of connection interfaces (8*a*, 8*b* . . . 8*n*), of doors (10*a*, 10*b* . . . 10*n*), of joining means (12*a*, 12*b* . . . 12*n*), and of means for maneuvering each door (10*a*, 10*b* . . . 10*n*).

Such a production line 4 thus comprises an n number of transfer systems (1*a*, 1*b* . . . 1*n*) functionally arranged from upstream to downstream, the first in the order of operation being the system (7*a*, 8*a*, 10*a*, 11*a*, 12*a*) and the last being (7*b*, 8*b*, 10*b*, 11*b*, 12*b*).

Such a production line is designed to operate step by step in connection with each transfer system (1*a*, 1*b* . . . 1*n*). This means that a first container 3*a* is joined to the first transfer system 1*a* to transfer the content Ca, for example in the direction of the container 3 towards the chamber 2, and then that a second container 3*b* is joined to the second transfer system 1*b*, and so on until the nth container 3*n* is joined to the nth transfer system 1*n*. Each transfer system (1*a*, 1*b* . . . 1*n*) corresponds to a work station for implementing an operating stage of the process in question. Preferably, all of the containers (3*a*, 3*b* . . . 3*n*) are first structurally joined to the corresponding transfer systems (1*a*, 1*b* . . . 1*n*), their use for the respective transfers occurring in a staggered manner.

A cabinet 26 connected to the chamber 2 contains the means necessary for operation of the line 4.

The invention makes it possible, in the case of a production line 4 such as was just described, to control the operation of each transfer system (1*a*, 1*b* . . . 1*n*).

Actually, it is possible to do this in such a way that the control means (23*a*, 23*b* . . . 23*n*) for opening one—or each—of the doors (10*a*, 10*b* . . . 10*n*) of the production line 4 respond to the signal received from the means for producing a signal (22A, 22*b* . . . 22*n*) of a transfer system (1*a*, 1*b* . . . 1*n*) placed upstream. In this way, initiating one or more transfers is avoided since the latter would be unjustified because a previous transfer was not completed.

The process for implementing the transfer system 1 comprises the following series of stages:

- Data D regarding the container 3 in question or its content C are written onto the marking means 19,
- The container 3 is moved close to the chamber 2, their respective doors 10, 18 then being in the closed state,
- The container 3 is joined to the chamber 2, making their interfaces 8, 9 work with their joining means 12, 13,
- Using the reading means 20, the data D written on the marking means 19 are read, and using the storing means 21, the data D thus read are stored,
- Using the means for producing a signal 22, an output signal based on the data D read and/or stored is produced, and
- Lastly, using the control means 23, the opening of the first door 10, and thus the second door 18, is controlled, in response to the output signal.

The transfer system 1 is programmed and the implementation process organized so that the control means 23 do not allow—and even prevent—the control of the opening of the first door 10, if the output signal means that the container 3 in question must not be used for a transfer. This can have several causes, linked to, for example, the production process of the content C and of the container 3, to the identity itself of the latter (mixture of batches), to bad handling, to the fact that the container 3 or its content C is not authentic, or else to a transfer of a content C that should not have taken place for whatever reason.

In the case where the transfer system 1 also comprises a writing means 24, the marking means 19 being of the read/rewrite type, the process also comprises a stage in which, using the writing means 24, a piece of data corresponding to the fact that the container 3 was used for a transfer and thus joined to a first door 10 of a chamber 2 is written onto the marking means 19. As already indicated, this piece of data then is part of the set of data D stored by the marking means 19 of the container 3.

The transfer system 1 is programmed and its implementation process organized so that, in such a case, the control means 23 do not allow—and even prevent—the control of the opening of the first door 10, so that it is ensured that the container 3 is actually for a single use and cannot be reused subsequently for a transfer.

The process for implementing a transfer system 1 is such that, during the process of producing at least one container 3, preparing its content C, filling it with the content C, and treatment, it allows a number of pieces of information regarding the container 3 in question and its content 4 to be written onto the marking means 19. The desired traceability is thus ensured before, during, and after the transfer.

As results from the preceding description, the container 3 also comprises marking means 19 that can store data.

The arrangement of marking means 19 on the container 3 is now described more specially.

This arrangement can be the object of different possible embodiments, in the case where the marking means 19 come in the form of a label, such as an RFID label, the embodiments being adaptable in the event of other forms of marking means 19.

Figure 5:
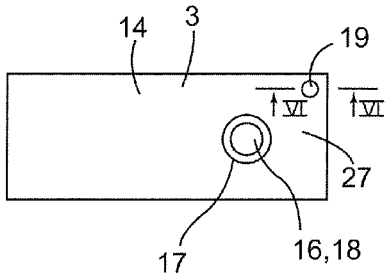
FIG. 5 is a diagrammatic top view of a container that illustrates a first embodiment of the arrangement of the marking means with the container.
Figure 6:
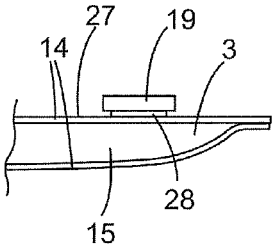
FIG. 6 is a cutaway view, partial and on a larger scale, of FIG. 5, along the line VI-VI.

In a first possible embodiment (FIGS. 5 and 6), the marking means 19 are connected to and rigidly attached to the outside surface 14*a* of the (second) wall 14 that forms an envelope, while being placed at least essentially onto the surface of the latter, an adhesion means 28—such as glue or the equivalent—being inserted between them. This embodiment must be compatible with the fact that the wall 14 can have much greater flexibility than that of the marking means 19. Preferably, the marking means 19 are located in the vicinity of the flange 27, of the second opening 16, of the second door 18 and/or in a less flexible area of the container 3 such as an area where the wall 14 is sealed together. This embodiment, moreover, must ensure an attachment that is normally inseparable of the holding means 19 to the wall 14.

Figure 7:
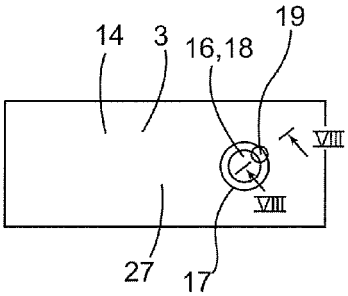
FIG. 7 is a diagrammatic top view of a container that illustrates a second embodiment of the arrangement of the marking means with the container.
Figure 8:
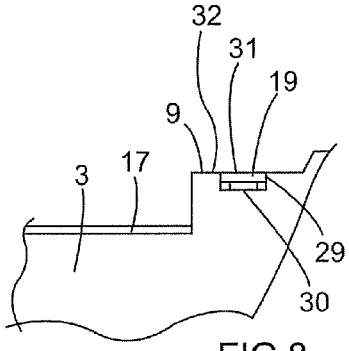
FIG. 8 is a cutaway view, partial and on a larger scale, of FIG. 7 along the line VII-VII.

In a second possible embodiment (FIGS. 7 and 8), the marking means 19 are connected to and attached rigidly to the flange 27 in a manner that is normally inseparable, inside a receiving cavity 29 provided in the flange 27, an adhesion means 30—such as glue or the like—being inserted between them, at the bottom of the cavity 29. In this embodiment, the cavity 29 and the marking means 19 can be of complementary dimensions so that, on the one hand, the marking means 19 are protected laterally, and, on the other hand, their free front surface 31 is at least essentially coplanar with the surface 32 of the flange 27 located around the cavity 29, in this case its front surface 32 forming an interface 9. Preferably, the front surface 31 of the marking means 19 does not project from the front surface 32 of the flange 27, so as not to disturb, or prevent, the mounting of the container 3 on the chamber 2.

Figure 9:
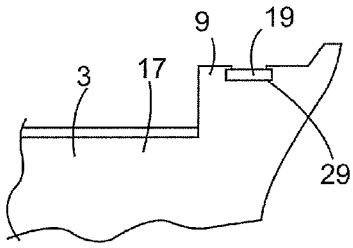
FIG. 9 is a diagrammatic cutaway view of a container that illustrates a third embodiment of the arrangement of the marking means with the container.
Figure 10:
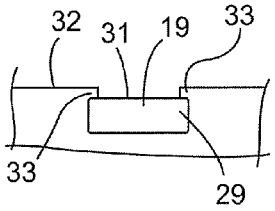
FIG. 10 is a partial view, and on a larger scale, of FIG. 9.

A third possible embodiment (FIGS. 9 and 10) is a variant of the second. Here, the marking means 19 are not attached to the flange 27 by an adhesion means such as that previously described, but are attached by inlaying and by forcible embedding into the receiving cavity 29 that comprises a projecting edge 33 in the form of a retaining lip that ensures that the marking means 19 are kept at the bottom of the receiving cavity 29. As previously, the free front surfaces 31 and 32 are at least essentially coplanar, and, preferably, the front surface 31 of the marking means 19 does not project from the front surface 32 of the flange 27. This embodiment offers the advantage of ensuring an inseparable attachment of the holding means 19 to the flange 27.

Figure 11:
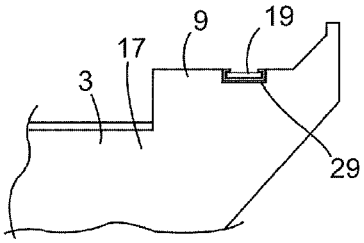
FIG. 11 is a cutaway diagrammatic view of a container that illustrates a fourth embodiment of the arrangement of the marking means with the container.
Figure 12:
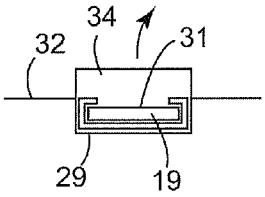
FIG. 12 is a partial view, and on a larger scale, of FIG. 11 that shows the presence of a cover that is to be removed after injection.

Instead of inlaying the marking means 19 in the flange 27, after the latter is carried out (typically by injection), a fourth possible embodiment (FIGS. 11 and 12) provides for an inlaying such as that which can be produced by the technique known by the name "in-mold" or a similar technique. Here, it involves producing the flange 27 by injection when the marking means 19 are already in place. Preferably, provisions are made to protect the latter during injection, in particular against heat, by means of a protective cover 34, which can be removed after injection. As with the preceding, this embodiment offers the advantage of ensuring an inseparable attachment of the holding means 19 to the flange 27.

Figure 13:
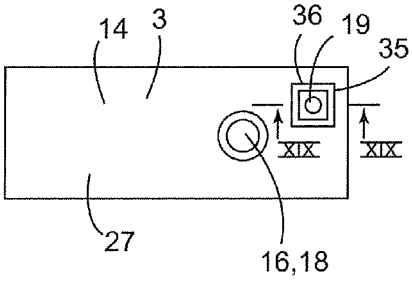
FIG. 13 is a diagrammatic top view of a container that illustrates a fifth embodiment of the arrangement of the marking means with the container.
Figure 14:
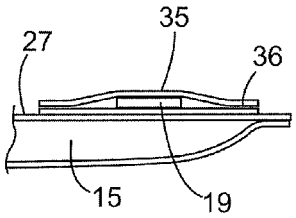
FIG. 14 is a cutaway view, partial and on a larger scale, of FIG. 5 along the line XIV-XIV.

In a fifth possible embodiment (FIGS. 13 and 14), the marking means 19 are enclosed in a pouch 35—for example, a pouch made of plastic material that has a certain flexibility—and this pouch 35 is in turn connected and attached rigidly, and in a manner that is normally inseparable, to the outside surface 14*a* of the (second) wall 14 that forms an envelope by gluing or sealing at 36. This embodiment often has the advantage that the marking means 19 are protected by the wall that constitutes the pouch 35.

In other variants of the embodiment, the pouch 35 is connected to the flange 27, or else it is partially connected to the (second) wall 14 and partially to the flange 27.

Preferably, the pouch 35—and thus the marking means 19—is located in the vicinity of the flange 27, the second opening 16, the second door 18 and/or in a less flexible area of the container 3 such as an area where the wall 14 is sealed together.

According to another variant of the embodiment, the pouch 35 is located not on the side of the outside surface 14*a* of the wall 14 forming an envelope, but on the side of its inside surface.

In a sixth possible embodiment (not shown), the marking means 19 are connected to the container 3 by a flexible or rigid, more or less long link. This embodiment offers the advantage of making it possible to move the marking means 19 away from the container 3 itself. This embodiment must be made so that the marking means 19 cannot be separated in an untimely manner from the container 3 with which they must form an inseparable unit.

As a rule, the marking means 19 are not in physical contact with the content C of the container and are placed towards the outside of it. The purpose of this structural arrangement or of any other similar arrangement is to keep the marking means 19 from being damaged following contact with the content C, or even, conversely, to keep the content C from being damaged after contact with the marking means 19.

The embodiments previously described do not exclude others fulfilling the same function, and the marking means 19 must, in any case, be structurally joined to the container 3 so as to form with it a normally inseparable unit. Actually, it is important that the holding means 19 obtained from a certain container 3 cannot be removed in order to join them to another.

The invention claimed is:

1. A biopharmaceutical system for transferring a certain content in one direction or another between a chamber and a sterile container that can be moved in relation to the chamber, the system comprising:

a chamber configured to hold the certain content therein, the chamber comprising:

a first wall provided with a first opening and a first connection interface, a first door configured to be in a closed state in which the first door closes the first opening or in an open state in which the first door opens the first opening, first joining means, a first maneuvering device configured to maneuver the first door to move the first door from one state to the other state, and means for actuating and controlling the first maneuvering device;

a container configured to hold the certain content therein and to be joined with the chamber, the container comprising:

a second wall provided with a second opening that, when the container is joined to the chamber, is in communication with the first opening, and provided with a second connection interface in addition to the first connection interface, a second door configured to be in a closed state in which the second door closes the second opening or in an open state in which the second door opens the second opening, second joining means configured to operate with the first joining means to carry out a stationary, detachable, and airtight joining of the container to the chamber, and a second maneuvering device configured to maneuver the second door to move the second door from one state to the other state, functionally joined to the first door so that the opening or closing of the first door respectively results in the opening or closing of the second door;

a data marking device which rests on the container and which stores data;

a short-range data reader configured to read the data from the data marking device when the container with the data marking device is proximate to the short-range data reader;

a storage configured to store the read data;

a signal production device configured to produce a first output signal based on the read data that is not previously-stored and a second output signal based on the stored data; and a controller configured to control the opening of the first door and the second door to allow transferring the content from one of the container and the chamber to the other of the container and the chamber, in response to the first output signal received from the signal production device when the container is joined to the chamber and the short-range data reader reads the data from the data marking device, and configured to prevent the first door from being opened to prevent transferring the content from the one of the container and the chamber to the other of the container and the chamber in response to the second output signal, thereby ensuring that the container is single use, wherein the data marking device, the reader, the storage, the signal production device, and the controller are functionally integrated into the system, and the data marking device is not in physical contact with the content of the container.

2. The system according to claim 1, further comprising a data writer configured to write data onto the data marking device, functionally joined to the opening and/or closing of the first door of the chamber.

3. The system according to claim 2, wherein one or more of the data reader and the data writer are located, at least during operation of the transfer system or in preparation for the operation, a short distance from the marking device.

4. The system according to claim 3, wherein one or more of the data reader and the data writer either rest on the chamber or are at least adjacent to the first door of the chamber or to the passage or location area of the container while the container is being joined to the chamber.

5. The system according to claim 2, wherein one or more of the data reader and the data writer do not rest directly on the chamber, but are located apart from the chamber, being either arranged in a stationary manner or movable.

6. The system according to claim 1, wherein one or more of the storage, the signal production device, and the controller rest on the chamber.

7. The system according to claim 1, wherein the data marking device is a read/rewrite type device.

8. The system according to claim 1, wherein the data marking device is a transponder or RFID label.

9. The system according to claim 2, wherein one or more of the data reader and the data writer are located, at least during operation of the transfer system or in preparation for the operation, a short distance from the first door or at least from a passage area of the container to join the container to the chamber or to locate the container during the joining.

10. The system according to claim 2, wherein one or more of the data reader and the data writer do not rest directly on the chamber, but are located apart from the chamber, being portable.

11. The system according to claim 1, wherein one or more of the storage, the signal production device, and the controller do not rest on the chamber.

12. The system according to claim 1, wherein the data marking device is a read-only type device.

13. A biopharmaceutical system for transferring a certain content in one direction or another between a chamber and a sterile container that can be moved in relation to the chamber, the system comprising:

a chamber configured to hold the certain content therein, the chamber comprising:

a first wall provided with a first opening and a first connection interface, a first door configured to be in a closed state in which the first door closes the first opening or in an open state in which the first door opens the first opening, first joining means, a first maneuvering device configured to maneuver the first door to move the first door from one state to the other state, and means for actuating and controlling the first maneuvering device;

a container configured to hold the certain content therein and to be joined with the chamber, the container comprising:

a second wall provided with a second opening that, when the container is joined to the chamber, is in communication with the first opening, and provided with a second connection interface in addition to the first connection interface, a second door configured to be in a closed state in which the second door closes the second opening or in an open state in which the second door opens the second opening, second joining means configured to operate with the first joining means to carry out a stationary, detachable, and airtight joining of the container to the chamber, and a second maneuvering device configured to maneuver the second door to move the second door from one state to the other state, functionally joined to the first door so that the opening or closing of the first door respectively results in the opening or closing of the second door;

a data marking device which rests on the container and which stores data;

a short-range data reader configured to read the data from the data marking device when the container with the data marking device is proximate to the short-range data reader;

a storage configured to store the read data;

a signal production device configured to produce a first output signal based on the read data that is not previously-stored and a second output signal based on the stored data; and a controller configured to control the opening of the first door and the second door to allow transferring the content from one of the container and the chamber to the other of the container and the chamber, in response to the first output signal received from the signal production device when the container is joined to the chamber and the short-range data reader reads the data from the data marking device, and configured to prevent the first door from being opened to prevent transferring the content from the one of the container and the chamber to the other of the container and the chamber in response to the second output signal, thereby ensuring that the container is single use, wherein the data marking device, the reader, the storage, the signal production device, and the controller are functionally integrated into the system, the data marking device is not in physical contact with the content of the container, and the sterile container is a single-use pouch.

14. A biopharmaceutical system for transferring a certain content in one direction or another between a chamber and a sterile container that can be moved in relation to the chamber, the system comprising:

a chamber configured to hold the certain content therein, the chamber comprising:

a first wall provided with a plurality of first openings and a plurality of first connection interfaces, a plurality of first doors configured to be in a closed state in which the first doors close the first openings or in an open state in which the first doors open the first openings, first joining means, at least a first maneuvering device configured to maneuver one of the first doors to move the one of the first doors from one state to the other state, and means for actuating and controlling the first maneuvering device;

a plurality of containers, each one of the plurality of containers being configured to hold the certain content therein and to be joined with the chamber, each of the containers comprising:

a second wall provided with a second opening that, when the container is joined to the chamber, is in communication with the first opening, and provided with a second connection interface in addition to the first connection interface, a second door configured to be in a closed state in which the second door closes the second opening or in an open state in which the second door opens the second opening, second joining means configured to operate with the first joining means to carry out a stationary, detachable, and airtight joining of the container to the chamber, and a second maneuvering device configured to maneuver the second door to move the second door from one state to the other state, functionally joined to the first door so that the opening or closing of the first door respectively results in the opening or closing of the second door;

a data marking device which rests on each of the containers and which stores data;

at least a short-range data reader configured to read the data from the data marking device when the respective container with the data marking device is proximate to the short-range data reader;

a storage configured to store the read data;

a signal production device configured to produce a first output signal based on the read data that is not previously-stored and a second output signal based on the stored data; and a controller configured to control the opening of the first door and the second door to allow transferring the content from one of the respective container and the chamber to the other of the respective container and the chamber, in response to the first output signal received from the signal production device when the respective container is joined to the chamber and the short-range data reader reads the data from the data marking device, and configured to prevent the first door from being opened to prevent transferring the content from the one of the respective container and the chamber to the other of the respective container and the chamber in response to the second output signal, thereby ensuring that the respective container is single use, wherein the data marking device, the reader, the storage, the signal production device, and the controller are functionally integrated into the system, wherein the data marking device is not in physical contact with the content of the respective container, and at least one or more of said sterile containers are single use pouches.

* * * * *